US006729111B2

(12) United States Patent
Wickham

(10) Patent No.: US 6,729,111 B2
(45) Date of Patent: May 4, 2004

(54) SYSTEM FOR PALLETIZING SCREWS AND OTHER HEADED ELEMENTS

(76) Inventor: John L. Wickham, 11752 Harford Rd., Glen Arm, MD (US) 21057

( * ) Notice: Subject to any disclaimer, the term of this patent is extended or adjusted under 35 U.S.C. 154(b) by 83 days.

(21) Appl. No.: 10/212,295

(22) Filed: Aug. 2, 2002

(65) Prior Publication Data

US 2003/0035706 A1 Feb. 20, 2003

Related U.S. Application Data

(60) Provisional application No. 60/312,660, filed on Aug. 15, 2001.

(51) Int. Cl.[7] ..... B65B 35/30; B65B 35/46

(52) U.S. Cl. ..... 53/539; 53/591; 53/534; 53/146; 53/251

(58) Field of Search ..... 53/591, 534, 539, 53/246, 247, 251, 250, 142, 236

(56) References Cited

U.S. PATENT DOCUMENTS 2,982,595 A * 5/1961 Rogers, Jr. ..... 227/136
3,165,868 A * 1/1965 McDonald et al. ..... 53/475
3,291,081 A * 12/1966 McDonald et al. ..... 112/104
3,411,266 A * 11/1968 Dix ..... 53/142
3,432,985 A * 3/1969 Halstead ..... 53/140
3,538,673 A * 11/1970 Mosetich et al. ..... 53/118
3,611,656 A * 10/1971 Chidsey, Jr. ..... 53/398
3,616,083 A * 10/1971 Mohr ..... 156/513
3,736,198 A * 5/1973 Leistner ..... 156/65
3,878,663 A * 4/1975 Shelton ..... 53/399
3,992,852 A * 11/1976 Schwarz et al. ..... 53/591
4,156,335 A * 5/1979 Strobl et al. ..... 53/444
4,429,512 A * 2/1984 Pegon, Jr. ..... 53/534
4,466,229 A * 8/1984 Gino ..... 53/559
4,722,169 A * 2/1988 DeSantis ..... 53/494
5,193,329 A * 3/1993 Loffredo et al. ..... 53/473
5,570,566 A * 11/1996 Newcomb ..... 53/437
5,609,712 A * 3/1997 Takumi ..... 156/298

* cited by examiner

*Primary Examiner*—Stephen F. Gerrity
*Assistant Examiner*—Hemant Desai
(74) *Attorney, Agent, or Firm*—Armstrong, Kratz, Quintos, Hanson & Brooks, LLP

(57) ABSTRACT

A machine for palletizing elements having a head, a shank and a tip. An auger has a first portion having a variable pitch and a second portion having a constant pitch. A plurality of the elements are directed onto the auger and retained on the auger. A transfer arm moves the plurality of elements from the auger and introduces the plurality of elements to a tray having rows of holes therein. Several embodiments are disclosed.

21 Claims, 14 Drawing Sheets

SYSTEM FOR PALLETIZING SCREWS AND OTHER HEADED ELEMENTS

CROSS REFERENCE

This application is related to provisional patent application Ser. No. 60/312,660 filed Aug. 15, 2001, entitled "Automated System for Palletizing Screws and Other Headed Elements".

BACKGROUND OF THE INVENTION

1. Field of the Invention

The present invention relates to a system for palletizing screws and more particularly to an apparatus which automatically and rapidly loads screws or other headed elements into holes in a tray.

2. Description of Related Art

Screws and similar elements having heads, shanks and tips have been loaded into trays so that subsequent batch processing operations can proceed. These operations include the application of paint or other coatings onto the screw head area; and moving the screws through heat treating ovens. Up until now, the trays have been loaded either by hand, or by the use of shaker tables, where, it was hoped, a percentage of the screws would end up with their shanks hanging through the tray's holes. But both methods have proven to be very labor-intensive.

BRIEF SUMMARY OF THE INVENTION

It is an object of the present invention to automatically and rapidly load headed elements such as screws into a series of holes in a tray.

It is a further object of the present invention to align a plurality of screws in a row and, transfer the entire row, simultaneously to holes in a tray.

In accordance with the teachings of the present invention there is disclosed a machine for palletizing screws and other elements having a head, a shank and a tip. The machine has an auger having a variable pitch. Means are provided for feeding a plurality of screws, in sequence, onto the auger. A transfer arm has means thereon to remove the screws from the auger. Means are provided for moving the transfer arm to and from the auger. Means are provided for removing the screws from the transfer arm and introducing the screws into a tray having a plurality of holes therein. The screws are automatically and rapidly received in the holes in the tray.

In further accordance with the teachings of the present invention, there is disclosed a machine for palletizing screws and other elements having a head, a shank and a tip. The machine has an auger having a first portion and a second portion. The first portion has a variable pitch, the second portion has a constant pitch. Means are provided for feeding a plurality of screws, in sequence, onto the auger. A vane is disposed adjacent to the first portion of the auger, the vane directing each screw onto the first portion of the auger. A transfer arm has means thereon to remove the screws from the auger. The transfer arm is movable with respect to the auger. Means are provided for removing the screws from the transfer arm and introducing the screws into a tray having a plurality of holes therein. The shanks of the screws are automatically and rapidly received in the holes in the tray.

In still further accordance with the teachings of the present invention, there is disclosed a machine for palletizing screws and other elements having a head, a shank and a tip. The machine has a first auger having a first portion and a second portion. The first portion has a variable pitch, the second portion has a constant pitch. Means are provided for feeding a plurality of screws, in sequence, onto the auger. A second auger is disposed adjacent and parallel to the first auger. The second auger directs the head of each screw onto the first portion of the first auger. A transfer arm has means thereon to remove the screws form the first auger. The transfer arm is movable with respect to the first auger. Means are provided for removing the screws from the transfer arm and introducing the screws into a tray having a plurality of holes therein. The shanks of the screws are automatically and rapidly received in the holes in the tray.

In yet further accordance with the teachings of the present invention, there is disclosed a machine for palletizing screws and other elements having a head, a shank and a tip. The machine has a first auger having a first portion and a second portion. The first portion has a variable pitch, the second portion has a constant pitch. Means are provided for feeding a plurality of screws, in sequence, onto the first auger. A second auger is disposed below and parallel to the first auger. A third auger is disposed above and parallel to the first auger. All three augers are rotated in the same direction. The head of each screw contacts the third auger, the shank of each screw contacts the first auger and the tip of each screw contacts the second auger. A transfer arm has means thereon to remove the screws from the augers, the transfer arm is movable with respect to the augers. Means are provided for removing the screws form the transfer arm and introducing the screws into a tray having a plurality of holes therein. The shanks of the screws are automatically and rapidly received in the holes in the tray.

Moreover, in accordance with the teachings of the present invention, there is disclosed a machine for palletizing screws and other elements having a head, a shank and a tip. The machine has a first auger having a first portion and a second portion. The first portion has variable pitch, the second portion has a constant pitch. A second auger is disposed adjacent and parallel to the first auger, the second auger being in the same vertical plane as the first auger. Means are provided for feeding a plurality of screws, in sequence, onto the augers. At least one upper drum is disposed above the first auger, the heads of the screws being received in the at least one upper drum. At least one lower drum disposed below the second auger, the tips of the screws having received in the at least one lower drum. Means are provided for rotating the at least one upper drum and the at least one lower drum in synchronization wherein the plurality of screws are displaced from the augers. A plurality of down tubes are disposed beneath the augers wherein the screws are directed to a tray having a plurality of holes therein. The screws are automatically and rapidly received in the holes in the tray.

These and other objects of the present invention will become apparent from a reading of the following specification taken in conjunction with the enclosed drawings.

DESCRIPTION OF THE PREFERRED EMBODIMENTS

Figure 1:
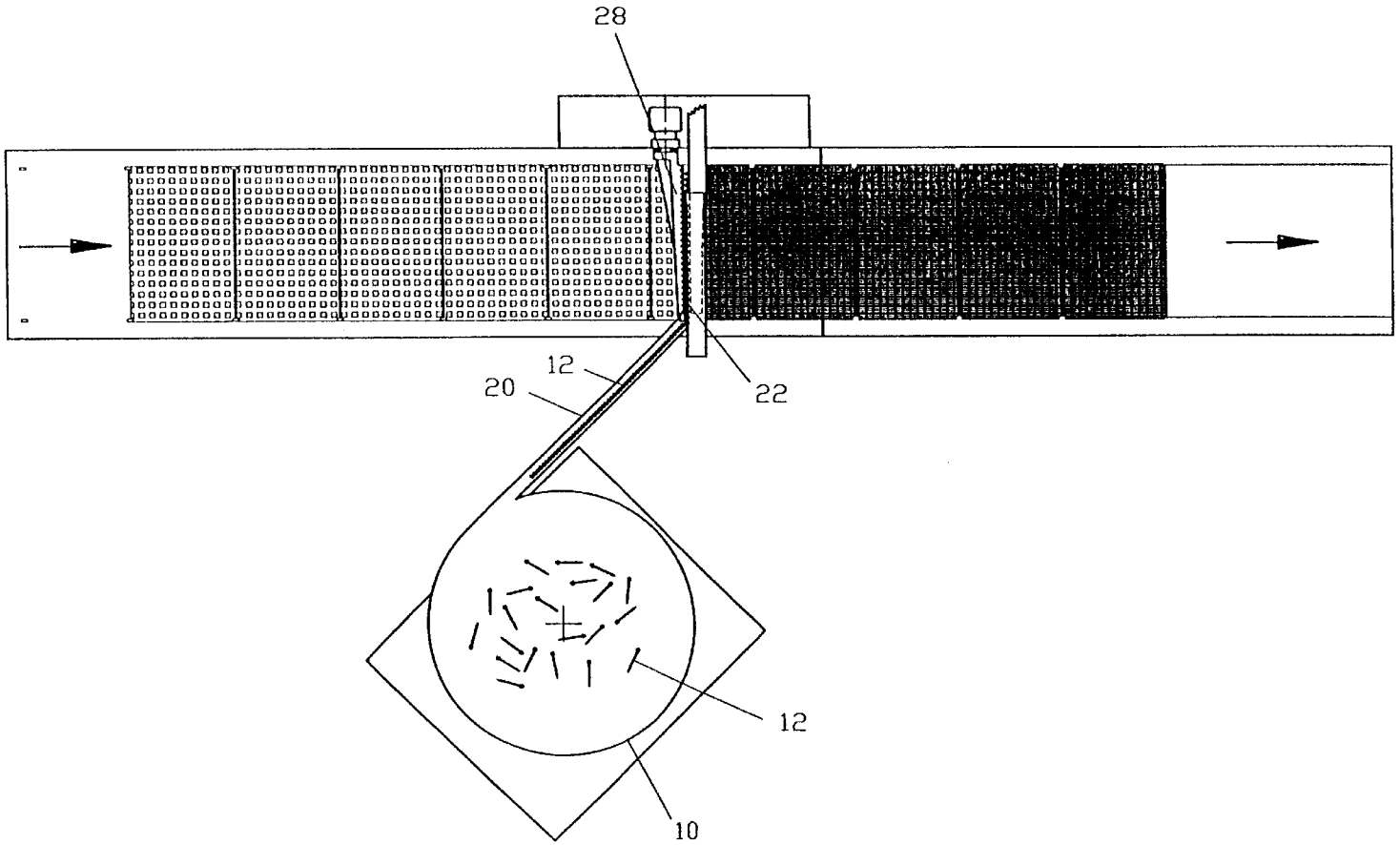
FIG. 1 is a top plan schematic view of the machine of the present invention.

Referring now to FIG. 1, a single unit of the machine of the present invention has a vibratory bowl feeder 10 into which a plurality of screws 12 are loaded in random order. Preferably all of the screws are of the same size and type so that the palletized product has all identical screws. As used herein, "screws" includes any element with a head 14, connected to a shank 16 which has a tip 18. For convenience of expression, "screw" as used herein includes headed elements with and without threaded shanks. Further included are elements with and without slots in the head and heads which are circular or have flat sides to cooperate with a wrench. The output of the vibratory bowl feeder 10 is directed to an in-line vibratory linear feeder 20 where the screws are separated and disposed on a moving surface leading from the vibratory bowl feeder 10 to sorting and loading position of the machine as will be described. It is noted that for high volume production, a number of the single units may be used. The following description is for a single unit.

Figure 2:
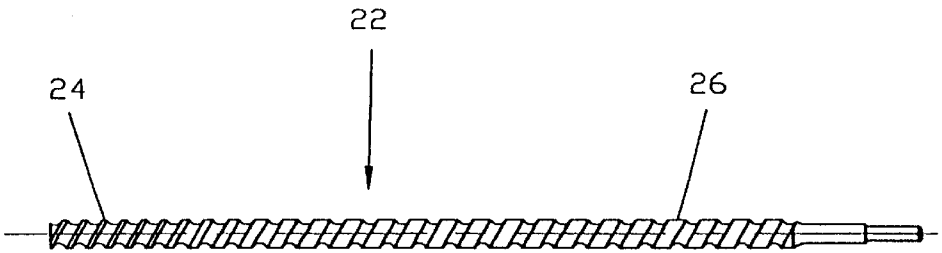
FIG. 2 is a top plan view of an auger having a first portion and a second portion.
Figure 3:
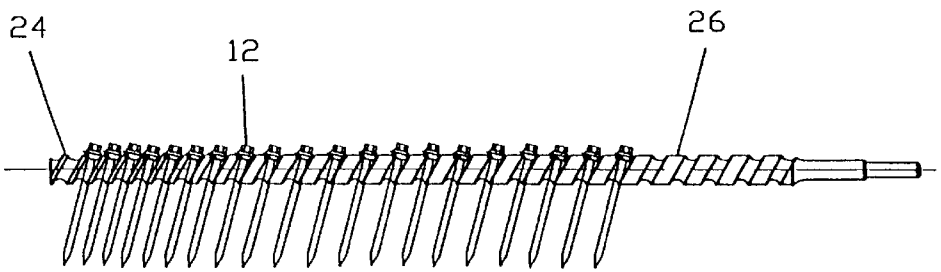
FIG. 3 is a perspective view having screws stretched out in the first portion of the auger.

The in-line vibratory linear feeder 20 carries the screws 12 to an auger 22. Preferably the auger has a first portion 24 and a second portion 26 (FIG. 2). The auger 22 may be approximately 30 inches in length. The first portion 24 may be approximately 10 inches in length. The first portion 24 has a variable pitch, the pitch increasing in length as the screws 12 proceed down the length of the first portion 24. The second portion 26 has a constant pitch. As the screws 12 approach the first portion 24 of the auger 22, the head of the screw contacts the thread on the rotating auger 22, the screw 12 is stripped off from the linear feeder 20 and is moved along the auger toward the second portion 24. Successive screws are each separately moved along the auger 22. Due to the variable pitch of the first portion 24, the screws 12 are stretched out in their spacing (FIG. 3). The final spacing of the screws is determined by the spacing of holes in a tray as will be described. The screws 12 are moved onto the second portion 26 of the auger 22 which has a constant pitch and the screws 12 are equidistant from the adjacent screws. It is preferred that the second portion 26 of the auger 22 have a length to receive twenty (20) screws.

Figure 4:
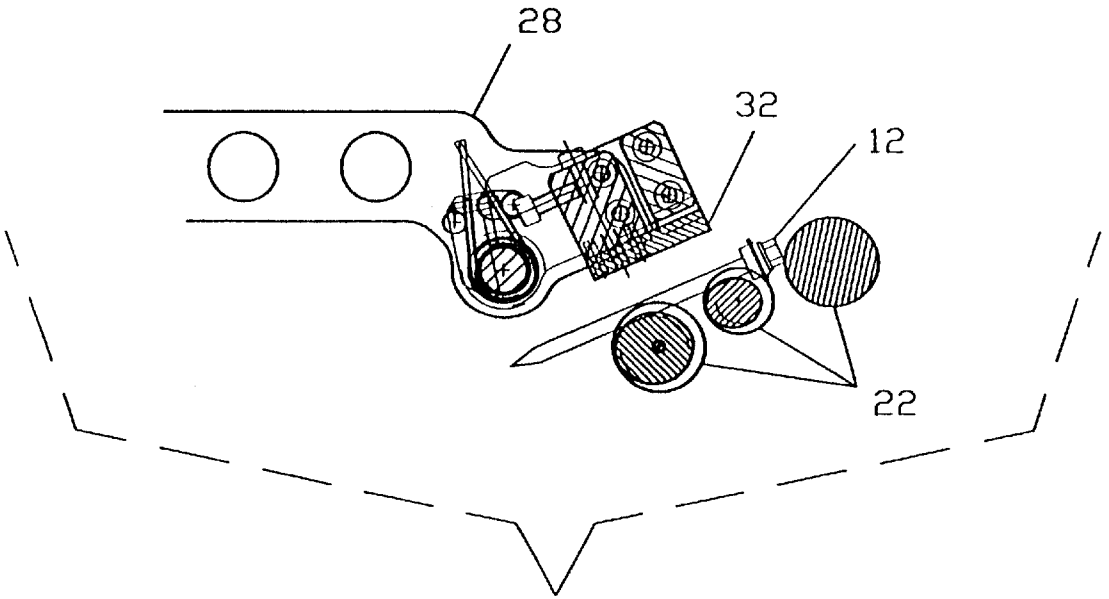
FIG. 4 is a perspective view of the transfer arm distal from the auger.
Figure 5:
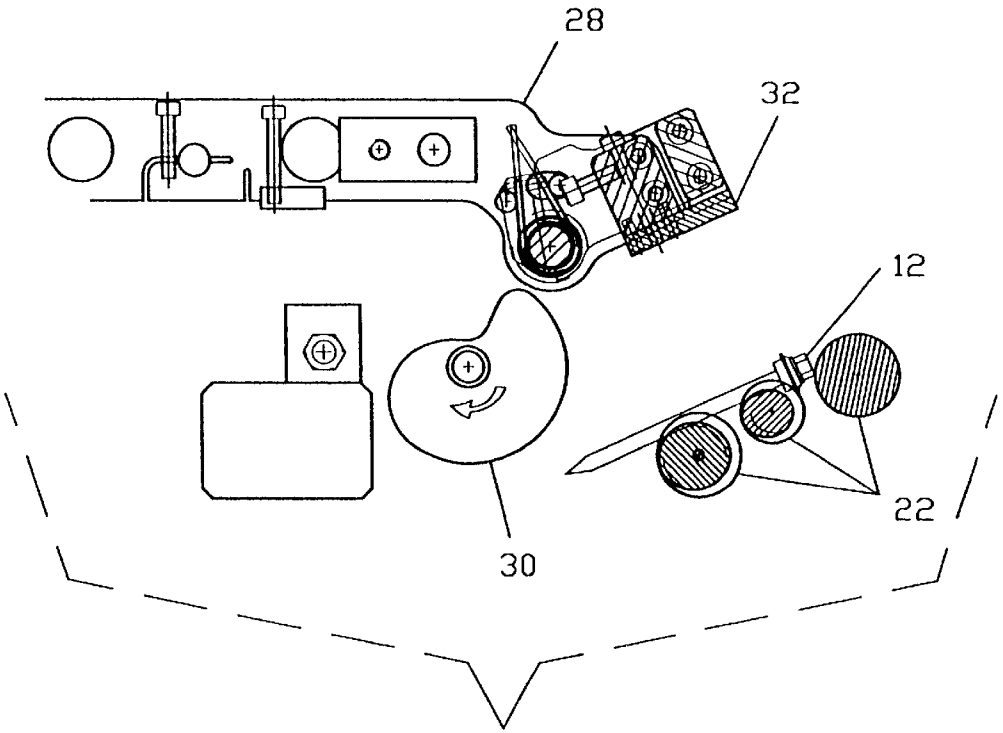
FIG. 5 is a perspective view showing means for moving the transfer arm proximal to the auger.

As shown in FIG. 4, a transfer arm 28 is disposed opposite the auger 22 and is movable to and from the auger 22. It is preferred that the transfer arm 28 ride on a cam 30. The shape of the cam 30 is such that the transfer arm 28 is adjacent to the auger 22 for a very brief period of time. The transfer arm 28 has means thereon to remove the screws 12 from the second portion 26 of the auger 22. In a preferred embodiment, the transfer arm 28 has a plurality of spaced-apart magnets 32 mounted on the transfer arm. The spacing between the magnets 32 corresponds to the spacing of the screws 12 on the second portion 26 of the auger 22. The transfer arm is moved on the cam 30 so the magnets 32 contact the screws 12 and attract the screws 12 from the auger 22. Pressure is applied to the follower against a sudden rise on the cam 30 which momentarily slows or stalls rotational movement of the auger 22 at the same time as the magnets 32 attract the screws 12. This is accomplished by a slip clutch 34 in the drive train (FIG. 5).

Alternately, other means for removing the screws 12 from the auger and picking up of the screws 12 by the transfer arm 28 which are known to persons skilled in the art, may be used. Mechanical means such as clamps or jaws may be carried by the transfer arm 28. Also, pneumatic means such as vacuum outlets on the transfer arm 28 may draw the screws 12 from the auger 22 and hold the screws on the transfer arm 28.

The transfer arm 28 is moved away from the auger 22 by the drive train and the screws 12 are released from the transfer arm 28. The nature of the release of the screws is dependent on the holding means. Any means known to persons skilled in the art may be used. For example, but not limiting, the magnetic attraction of the screws 12 may be broken by a mechanically driven pusher which is extendable from beneath the magnet 32 to strike the screw 12 and break the magnetic attraction. The screws 12 may be exposed to an electric shock to break the magnetic attraction. Mechanical clamps or jaws may be opened to release the screws 12. Vacuum may be interrupted to release the screws 12.

Figure 6:
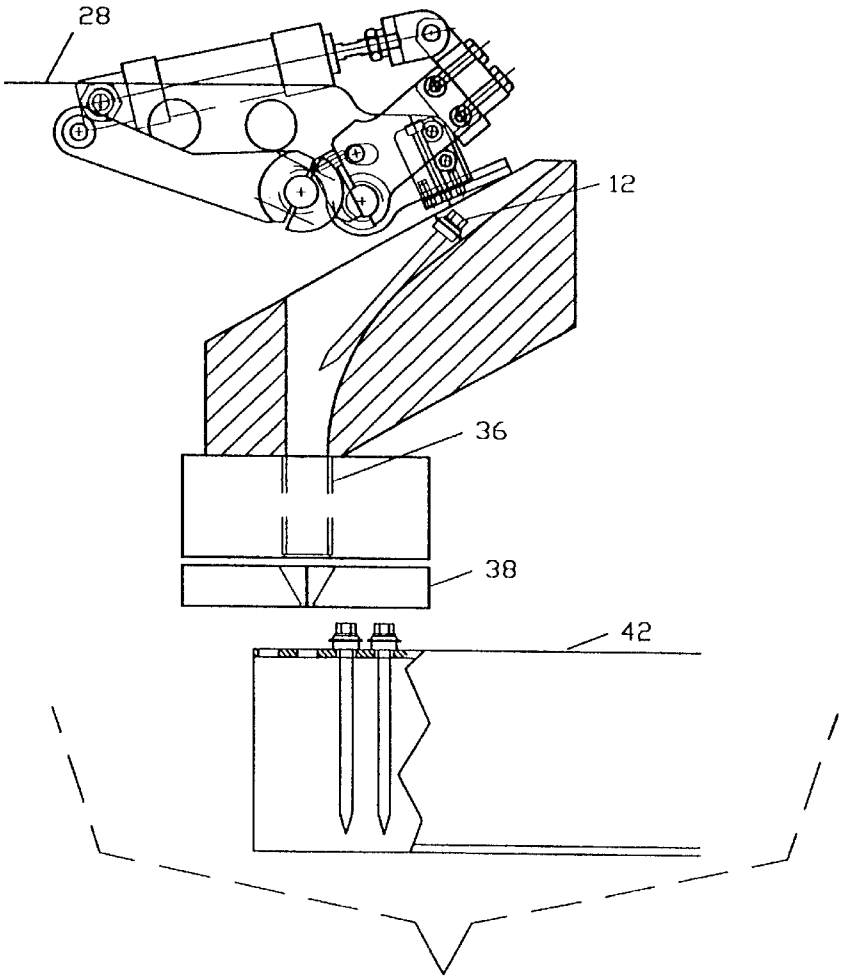
FIG. 6 is a perspective view showing screws falling into drum holes leading to split funnels.
Figure 7:
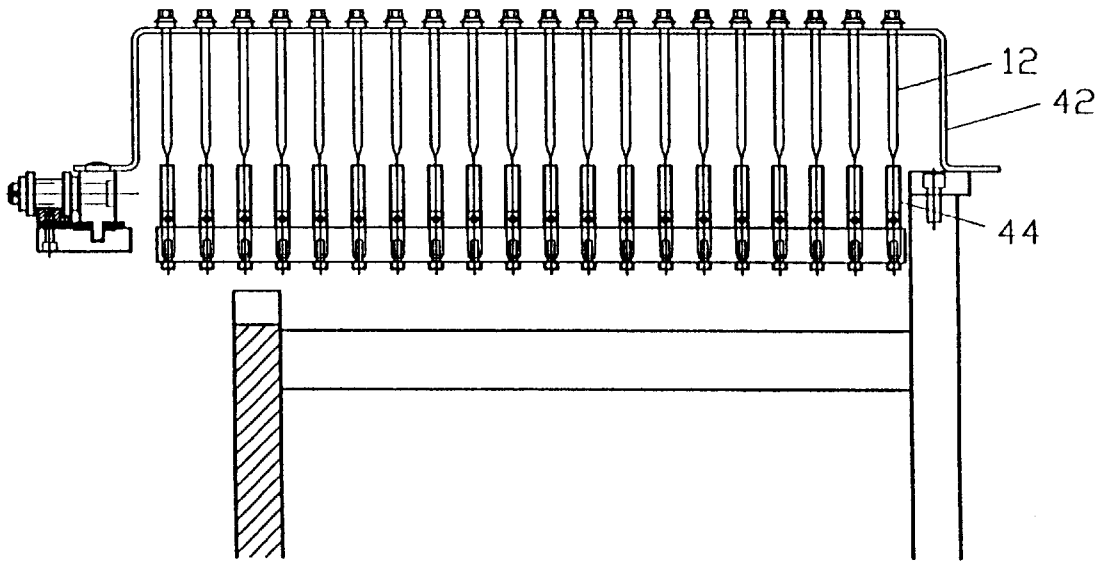
FIG. 7 is a perspective view showing pocket pins projecting upwardly through holes in the tray.

The screws 12 are all released simultaneously and each screw 12 falls into a respective down tube 36 immediately below the transfer arm 28 (FIG. 6).

At the bottom of each down tube 36, there is a corresponding split funnel 38. The split funnel 38 is formed of two mirror image half funnels which may be separated. When closed, the shanks 16 of the screws 10 extend into the stem of the funnel 38 and the heads 14 of the screws 12 are too large to pass into the funnel stem. The split funnels 38 are opened to release the screw heads 12 and the shanks 16 of the screws 12 drop directly into corresponding holes 40 in a tray 42 which is disposed under the funnels.

Figure 8:
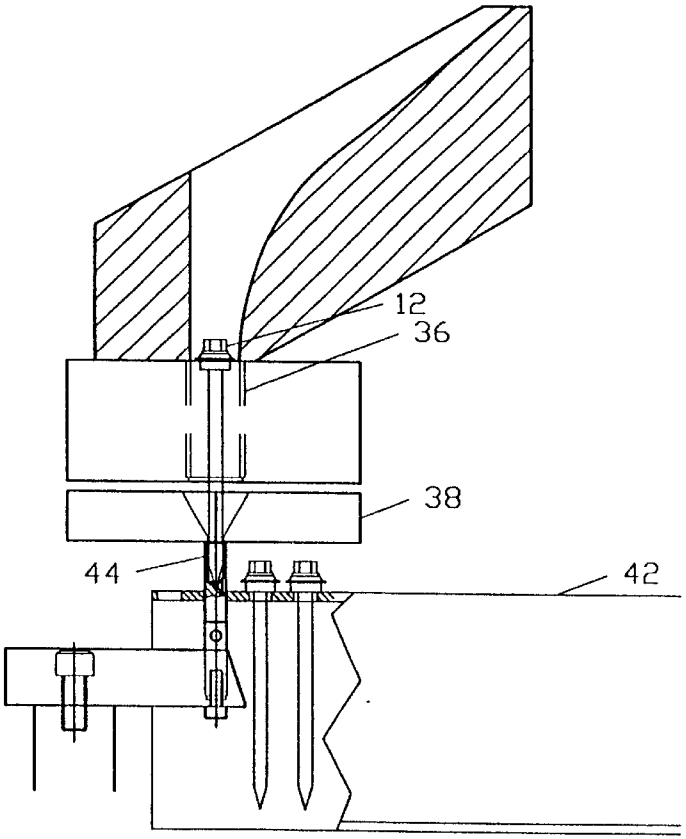
FIG. 8 is a side elevation view showing a screw being directed by a pocket pin.

In order to more positively guide the shanks 16 of the screws 12 into the holes 40, pocket pins 44 are removably disposed through the row of holes 40 in the tray 42. Each pocket pin 44 is a rod having a cavity in the upper end. The tips 18 of the screws 12 are received in the respective cavities and, as the pocket pins 44 are withdrawn from the holes 40 in the tray 42. The shanks 16 of the respective screws 12 are directed into the holes 40 (FIG. 8).

In this manner, a tray 42 having any desired number of screws 12 may be palletized. The tray is palletized when the hole on the tray are fully loaded and available for stacking, storage or further treatment. Further treatment includes, but is not limited to, painting the heads and/or heat treating the screws. It is preferred that twenty (20) screws be disposed on the second portion of the auger 22, all being moved by the transfer arm 28 and dropped into the split funnels 38. In this manner, twenty holes 40 are filled in the tray 42 in a single transfer. Thus, a tray 42 having fifty (50) parallel rows containing twenty (20) screws per row is a convenient and practical size.

Figure 9:
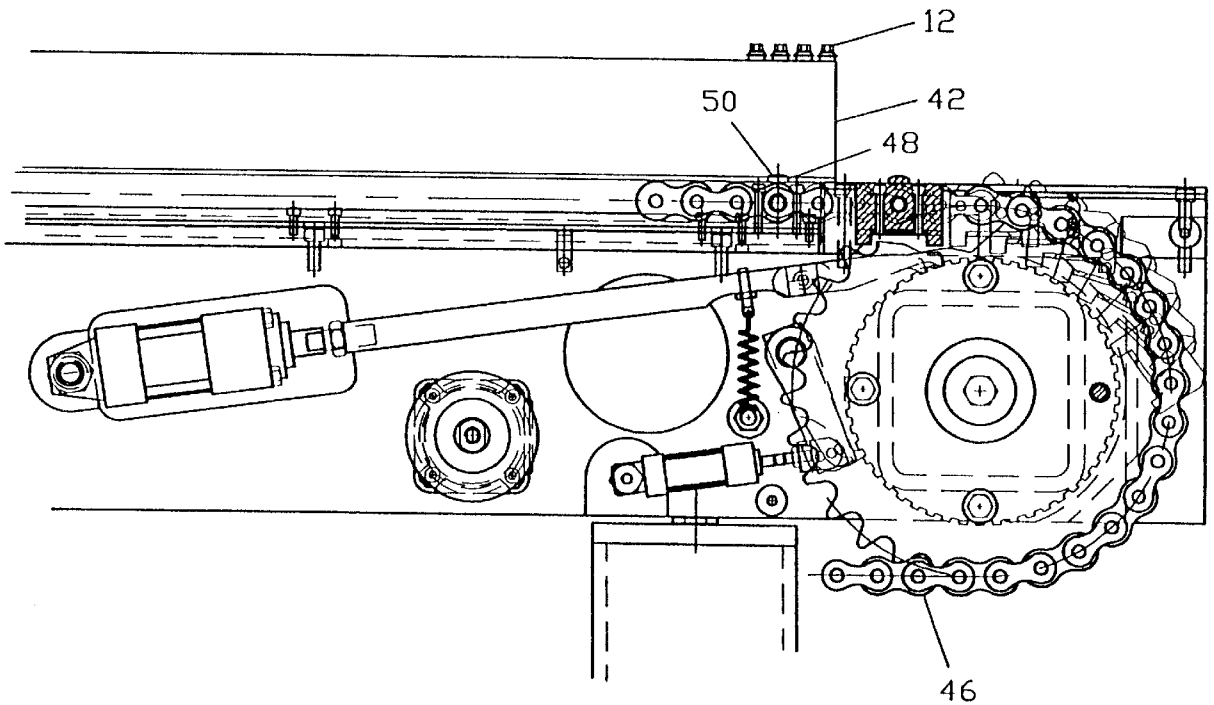
FIG. 9 is a prospective view showing a chain drive conveyer.
Figure 10:
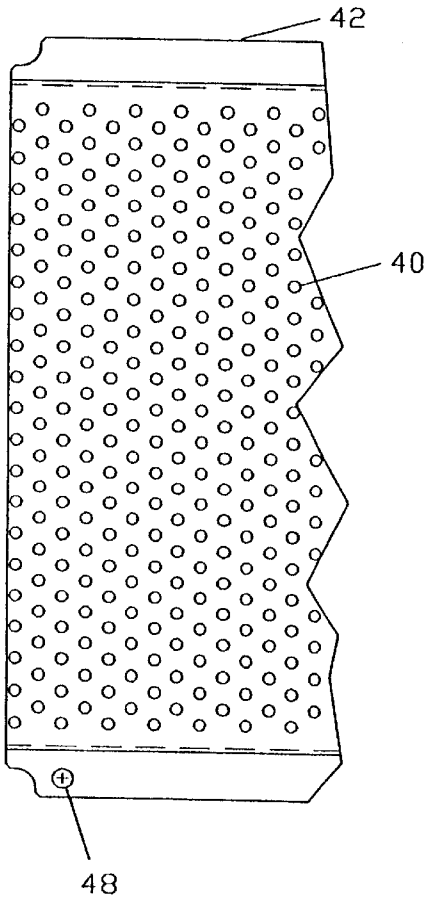
FIG. 10 is a perspective view of a portion of the tray.

In order to incrementally move the tray 42 so that a succeeding row of holes 40 may be filled, an indexing means is provided. The indexing means may be a ratchet driven chain conveyor 46 (FIG. 9). Alternately, the indexing means may be at least one opening 48 formed in a base flange on the tray 42 (FIG. 10). A pin 50 extending upwardly from a chain drive 46 engages the opening 48 and moves the tray 42 by a desired distance at which point the pin 50 is disengaged from the opening 48 in the base flange. The indexing means is not limited to the examples described herein but may be indexing means known to persons skilled in the art. The indexing means may include, but not be limited to, indexing belt drives, cranks and pawls.

The holes 40 in the tray 42 preferably are arranged in a series of parallel rows. Preferably, adjacent rows are offset from each other and alternate rows are in alignment with each other (FIG. 10). The indexing means incrementally moves the tray 42 a distance equal to the space between the rows. Also, the tray 42 is moved back and forth sideways as it is indexed along. The amount of sideway movement is equal to the offset distance between adjacent rows. It is not essential that the adjacent rows be offset from each other, the rows may all be aligned. Offset orientation is useful for painting the heads of the screws 12 to reduce the amount of paint required.

In a preferred embodiment, the machine loads 420 screws per minute into the tray 42. A plurality of trays 42 are fed sequentially through the machine so there is no interruption to the filling. The holes 40 on the loading edge and the trailing edge of each tray are spaced one-half of the spacing between the rows of holes so that when two trays are butted together, the spacing between the rows remain constant despite the rows being in adjoining trays.

Figure 11:
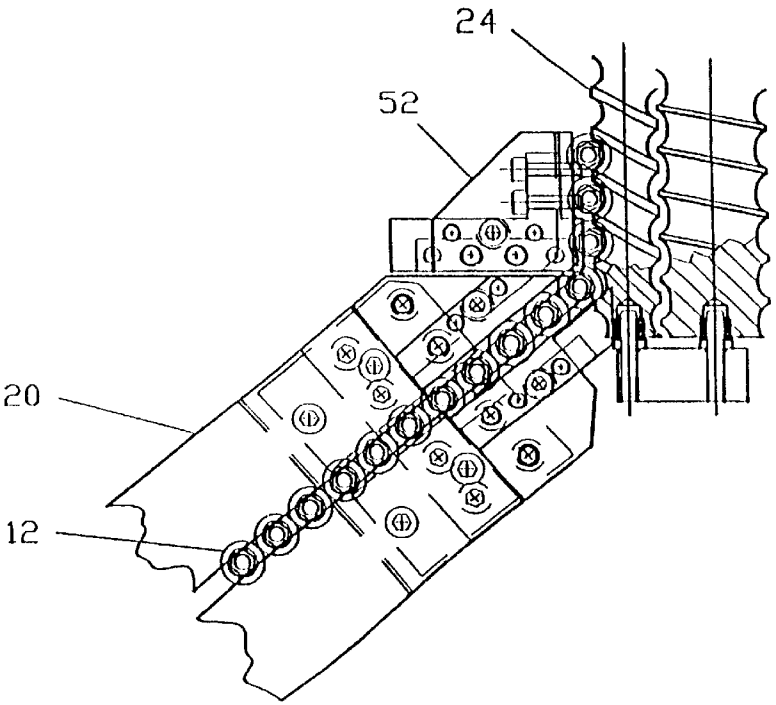
FIG. 11 is a perspective view showing the spring-loaded blade on the in-line vibratory feeder.

It is preferred that the in-line vibratory feeder 20 have a spring-loaded blade 52 disposed at the stripping off point where the vibratory feeder 20 adjoins the first portion 24 of the auger 22 (FIG. 11). The spring-loaded blade 32 urges each screw onto the thread of the auger in a desired orientation and holds each screw on the rotating auger for a sufficient period to assure the retention of the screw. In the event that a screw is improperly oriented, the spring-loaded blade urges the screw onto the auger and permits potential jams to clear themselves and not to interrupt the production cycle.

Figure 12:
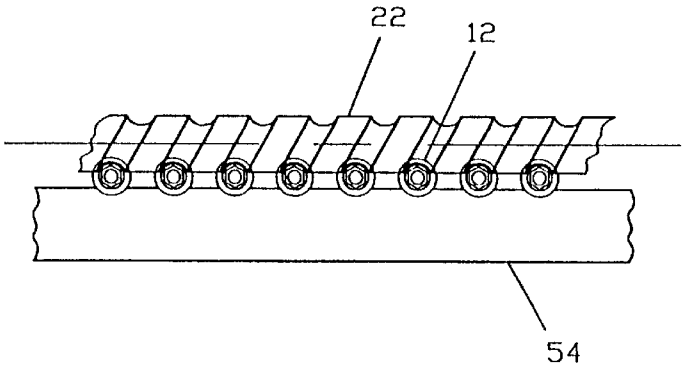
FIG. 12 is a perspective view showing a vane adjacent to the first portion of the auger.

In one embodiment, a vane 54 is disposed adjacent to the first portion 24 of the auger 22. The vane 54 directs the head 14 of each screw 12 onto the first portion 24 of the auger as shown in FIG. 12.

Figure 13:
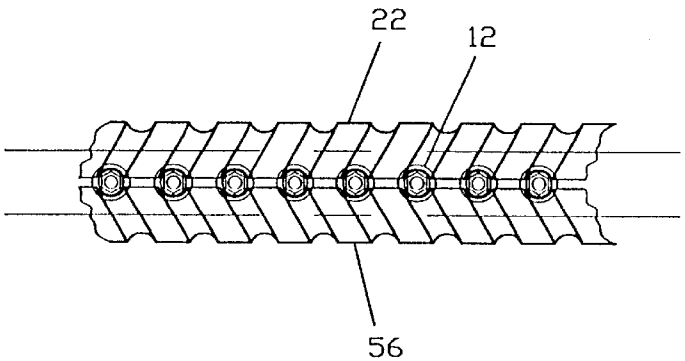
FIG. 13 is a perspective view showing a second auger adjacent to the auger.

A second embodiment provides a second opposed auger 56 disposed adjacent to and parallel to the auger 22. The augers are in the same horizontal plane. The augers 56, 22 rotate in opposite directions. The second auger 56 directs the heads 14 of the screws onto the first portion 24 of the auger 22 as shown in FIG. 13.

Figure 14:
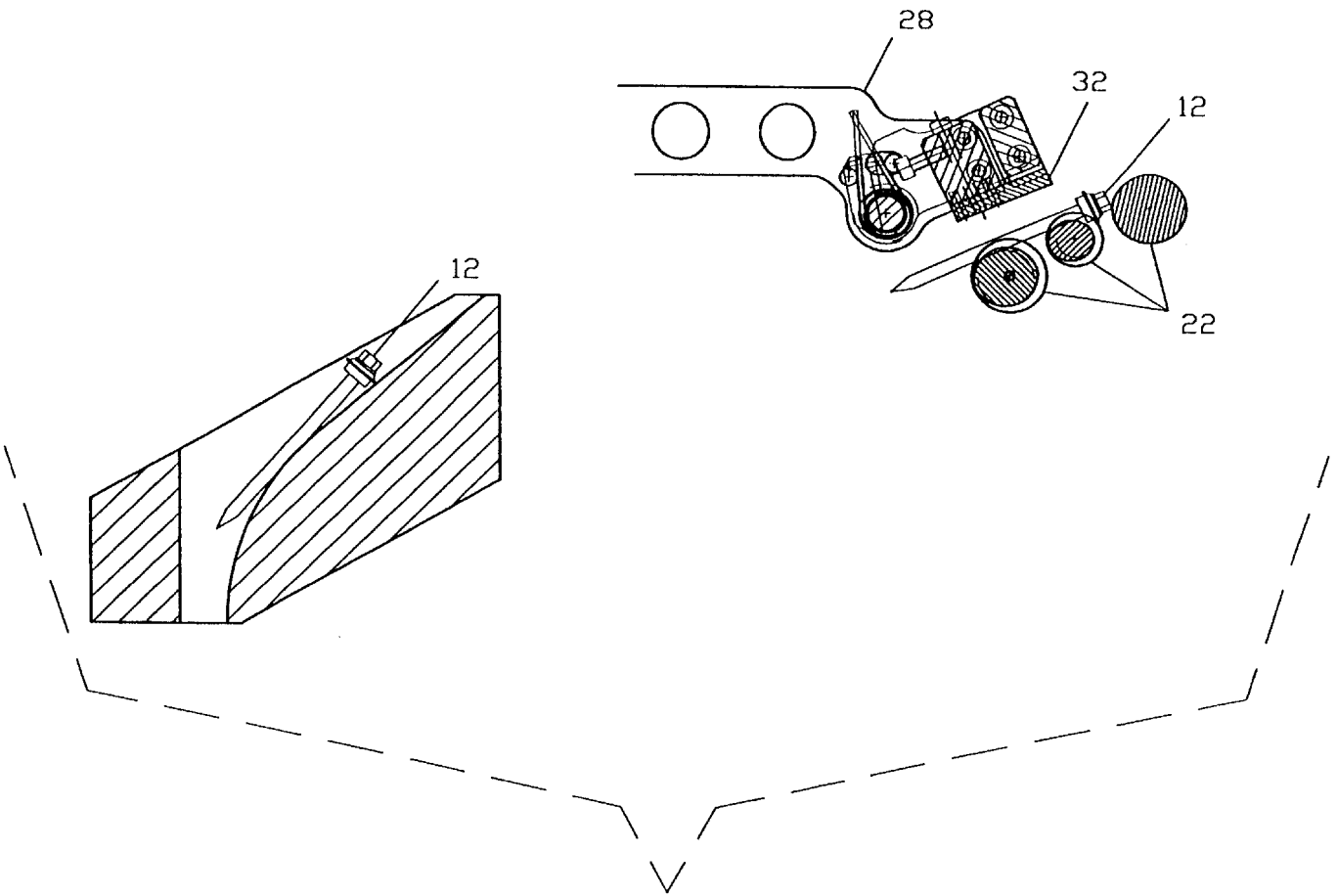
FIG. 14 is a perspective view showing the machine having three augers.

A third embodiment has three augers. The first auger 22 has a variable pitch first portion 24 and a constant pitch second portion 26. A second auger is disposed below and parallel to the first auger 22. A third auger 60 is disposed above and parallel to the first auger 22. All three augers rotate in the same direction. The head 24 of the screw 12 contacts the third auger 60, the shank 66 of the screw 12 contacts the first auger 22, and the tip 18 of the screw 12 contacts the second auger 60 (FIG. 14). Preferably, the three augers are not exactly vertically aligned but are inclined with respect to a vertical axis. The inclination prevents the screws from falling off of the augers. Although the angle of inclination is not critical, an angle of approximately 20° is preferred.

Figure 15:
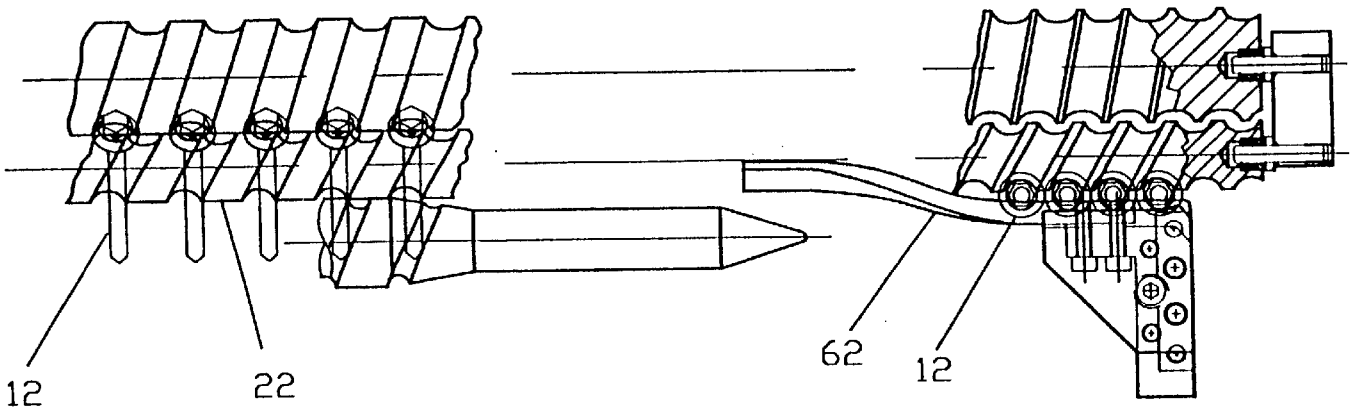
FIG. 15 is a perspective view showing a wrap finger directing the screws onto the auger.

In the third embodiment, a wrap finger 62 is connected to the in-line vibratory feeder 20 at the stripping off point adjacent to the first portion 24 of the auger 22 as shown in FIG. 15. The wrap finger 62 is a curved finger which contacts the shank 16 of the screw as the screw 12 exits the vibratory feeder 20. The wrap finger has an upward curvature and directs the head 14 each successive screw toward the thread on the auger to align the screw on the auger 22. Thus, each screw 14 is rotated for the selected position to be seated on the auger 22.

Figure 16:
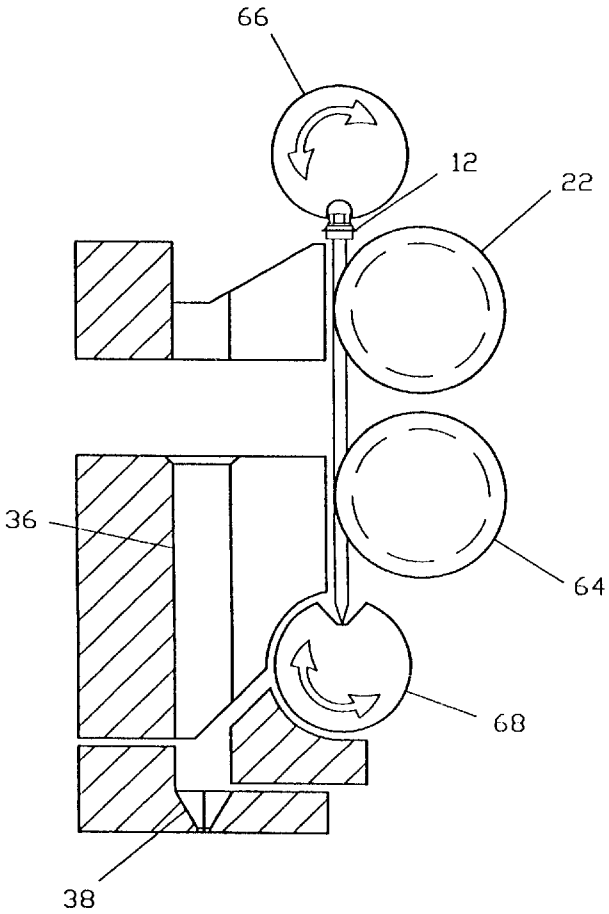
FIG. 16 is a diagram showing a machine having two augers and drums to remove screws from the augers.

In another embodiment, the machine does not have a transfer arm. As shown in FIG. 16, a first auger 22 has a first portion 24 with a variable pitch and a second portion 26 with a constant pitch. A second auger 64 having a constant pitch is disposed adjacent to and parallel to the first auger 22. The augers are in the same vertical plane and rotate in the same direction. At least one upper drum 66 is disposed above the first auger 22. The heads 14 of the screws 12 are received in the at least one upper drum 66. At least one lower drum 68 is disposed below the second auger 64. The tips 18 of the screws 12 are received in the at least one lower drum 68. Preferably, each drum 66, 68 has a notch formed therein to engage the screw 12 to more easily displace the screw 12. Means are provided for rotating the at least one upper drum 66 in synchronization with the at least one lower drum 66. When the drums 66, 68 are rotated, the plurality of screws 12 which are carried by the augers 22, 64 are displaced from the augers 22, 64 and the screws 12 fall into down tubes 36 as described above for the other embodiments. The down tubes 36, split funnels 38 and trays 42 are the same as described above for palletizing the screws. This embodiment does not have any magnets and can be used for headed elements which are made of non-magnetic materials such as brass and aluminum.

The present invention overcomes the labor intensive sorting and palletizing of headed elements which has been used to date. The present machine is useful with screws, bolts, nails, and other headed elements. The present invention can be made with augers having any desired pitch to be used with headed elements of any length and diameters.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A machine for palletizing screws and other elements having a head, a shank and a tip, the machine comprising:

an auger having a variable pitch, means for feeding a plurality of screws, in sequence, onto the auger, a transfer arm having means thereon to remove the screws from the auger, means for moving the transfer arm to and from the auger, means for removing the screws from the transfer arm and introducing the screws into a tray having a plurality of holes therein, wherein the screws are automatically and rapidly received in the holes in the tray.

2. The machine of claim 1, wherein the means for feeding the plurality of screws, in sequence, onto the auger is a vibratory bowl feeder which directs the screws onto an in-line vibratory feeder, the in-line vibratory feeder carrying the screws to the auger.

3. The machine of claim 2, further comprising a spring-loaded blade urged against the screws on the in-line feeder such that screws are fed onto the auger without jamming.

4. The machine of claim 1, wherein the auger has a first portion connected to a second portion, the first portion having a first length having a variable pitch, the second portion having a second length having a constant pitch wherein the spacing of the screws are stretched out to a desired distance on the first portion of the auger and are maintained at the desired distance on the second portion.

5. The machine of claim 1, wherein the transfer arm has means thereon to remove the screws from the auger and to release the screws from the transfer arm.

6. The machine of claim 5, wherein the means to remove and release the screws are magnetic.

7. The machine of claim 5, wherein the means to remove and release the screws are mechanical.

8. The machine of claim 5, wherein the means to remove and release the screws are pneumatic.

9. The machine of claim 1, wherein the means to move the transfer arm is a driven cam on which the transfer arm rides.

10. The machine of claim 1, further comprising a plurality of down tubes disposed under the transfer arm wherein the plurality of screws are released from the transfer arm, each screw being directed into a separate down tube, each down tube being disposed over a respective split funnel such that each screw is received in a separate split funnel, the split funnels each being disposed over a respective hole in the tray, such that opening the split funnel deposits each of the screws in a respective opening in a row of holes in the tray.

11. The machine of claim 10, further comprising a plurality of spaced-apart pocket pins removably disposed through the row of holes in the tray, each pocket pin contacting the tip of a respective screw wherein the shanks of the screws are directed into the holes in the tray as the pocket pins are withdrawn from the row of holes in the tray.

12. The machine of claim 1, wherein a vane is disposed adjacent to the first portion of the auger, the vane directing each screw onto the first portion of the auger.

13. The machine of claim 1, wherein a second opposed auger is disposed adjacent and parallel to the auger, the augers being in the same horizontal plane, the augers rotating in opposite directions, the second auger directing the head of each screw onto the first portion of the auger.

14. The machine of claim 1, further comprising a second auger disposed below and parallel to the auger, a third auger disposed above and parallel to the auger, all three augers being rotated in the same direction, wherein the head of each screw contacts the third auger, the shank of each screw contacts the auger and tip of each screw contacts the second auger.

15. The machine of claim 14, further comprising a wrap finger connected to an in-line vibratory feeder disposed adjacent to the auger, the wrap finger rotating the screws to a selected position for seating on the augers.

16. The machine of claim 1, wherein the holes in the tray are arranged in a series of parallel rows having a space therebetween, the adjacent rows being offset a predetermined distance and alternate rows being in alignment, the machine having an indexing means wherein the tray is incrementally moved forwardly a distance equal to the space between the rows and the tray is moved sideways a distance equal to the offset disposition of adjacent rows.

17. A machine for palletizing screws and other elements having a head, a shank and a tip, the machine comprising:

an auger having a first portion and a second portion, the first portion having a variable pitch, the second portion having a constant pitch, means for feeding a plurality of screws, in sequence, onto the auger, a vane disposed adjacent to the first portion of the auger, the vane directing each screw onto the first portion of the auger, a transfer arm having means thereon to remove the screws from the auger, the transfer arm being movable with respect to the auger, means for removing the screws from the transfer arm and introducing the screws into a tray having a plurality of holes therein wherein the shanks of the screws are automatically and rapidly received in the holes in the tray.

18. A machine for palletizing screws and other elements having a head, a shank and a tip, the machine comprising:

a first auger having a first portion and a second portion, the first portion having a variable pitch, the second portion having a constant pitch, means for feeding a plurality of screws, in sequence, onto the auger, a second auger disposed adjacent and parallel to the first auger, the second auger directing the head of each screw onto the first portion of the first auger, a transfer arm having means thereon to remove the screws from the first auger, the transfer arm being movable with respect to the first auger, means for removing the screws from the transfer arm and introducing the screws into a tray having a plurality of holes therein wherein the shanks of the screws are automatically and rapidly received in the holes in the tray.

19. A machine for palletizing screws and other elements having a head, a shank and a tip, the machine comprising:

a first auger having a first portion and a second portion, the first portion having a variable pitch, the second portion having a constant pitch, means for feeding a plurality of screws, in sequence, onto the first auger, a second auger disposed below and parallel to the first auger, a third auger disposed above and parallel to the first auger, all three augers being rotated in the same direction, wherein the head of each screw contacts the third auger, the shank of each screw contacts the first auger and the tip of each screw contacts the second auger, a transfer arm having means thereon to remove the screws from the augers, the transfer arm being movable with respect to the augers, means for removing the screws from the transfer arm and introducing the screws into a tray having a plurality of holes therein, wherein the shanks of the screws are automatically and rapidly received in the holes in the tray.

20. The machine of claim 1, further comprising a wrap finger connected to an in-line vibratory feeder disposed adjacent to the third auger, the wrap finger rotating the screws to a selected position for seating on the augers.

21. A machine for palletizing screws and other elements having a head, shank and a tip, the machine comprising:

a first auger having a first portion and a second portion, the first portion having a variable pitch, the second portion having a constant pitch, a second auger disposed adjacent and parallel to the first auger, the second auger being in the same vertical plane as the first auger, means for feeding a plurality of screws, in sequence, onto the augers, at least one upper drum disposed above the first auger, the heads of the screws being received in the at least one upper drum, at least one lower drum disposed below the second auger, the tips of the screws being received in the at least one lower drum, means for rotating the at least one upper drum and the at least one lower drum in synchronization wherein the plurality of screws are displaced from the augers, a plurality of down tubes disposed beneath the augers wherein the screws are directed to a tray having a plurality of holes therein, wherein the screws are automatically and rapidly received in the holes in the tray.

* * * * *